US006776014B1

(12) United States Patent
Laycock et al.

(10) Patent No.: US 6,776,014 B1
(45) Date of Patent: Aug. 17, 2004

(54) METHOD TO MAKE CIRCULAR-KNIT ELASTIC FABRIC COMPRISING SPANDEX AND HARD YARNS

(75) Inventors: Graham Laycock, Grangeford (SG); Raymond S. P. Leung, Sratin (HK); Elizabeth T. Singewald, Wilmington, DE (US)

(73) Assignee: Invista North America S.a.r.l., Wilmington, DE (US)

( * ) Notice: Subject to any disclaimer, the term of this patent is extended or adjusted under 35 U.S.C. 154(b) by 0 days.

(21) Appl. No.: 10/454,746

(22) Filed: Oct. 20, 2003

(51) Int. Cl.[7] ..... D04B 1/18
(52) U.S. Cl. ..... 66/198; 66/202; 66/8; 442/306
(58) Field of Search ..... 66/202, 198, 197, 66/196, 200, 8; 442/304, 306, 313

(56) References Cited

U.S. PATENT DOCUMENTS

| | | | | |
|---|---|---|---|---|
| 3,392,552 A | | 7/1968 | Muller et al. | |
| 4,875,241 A | * | 10/1989 | Browder et al. | 2/409 |
| 5,198,288 A | | 3/1993 | Grunfeld | |
| 5,584,196 A | * | 12/1996 | Taylor et al. | 66/60 R |
| 5,687,587 A | * | 11/1997 | Michel | 66/196 |
| 5,931,023 A | * | 8/1999 | Brach et al. | 66/136 |
| 5,948,875 A | | 9/1999 | Liu et al. | |
| 6,263,707 B1 | | 7/2001 | Miller et al. | |
| 6,458,166 B1 | | 10/2002 | Fleissner | |
| 6,472,494 B2 | | 10/2002 | Houser et al. | |

FOREIGN PATENT DOCUMENTS

EP 0 369 822 A1 5/1990

OTHER PUBLICATIONS

DuPont: "Single Jersey Fabrics with LYCRA" Technical Bulletin L410, Jan. 24, 2001, pp. 1–14.

DuPont: "Wet Processing of Fabrics Containing LYCRA Elastane" Tchnical Bulletin L704, Oct. 15, 1999, pp. 1–21.

E.I. du Pont de Nemours and Company: "Dyeing and Finishing Circular Knit Fabrics with LYCRA" Technical Bulletin L713 Replaces Bulletin L712, 1999, pp. 1–29.

DuPont Nov. 3, 2000 letter to Customers—North American Lycra® Seamless Technical Team.

* cited by examiner

*Primary Examiner*—Danny Worrell
(74) *Attorney, Agent, or Firm*—Robert B. Furr, Jr.

(57) ABSTRACT

Circular-knit, elastic, single-knit jersey fabric, of spun and/or continuous filament hard yarns with bare spandex plated in every course, has a cover factor in the range of 1.3 to 1.9, a basis weight from 140 to 240 g/m$^2$, an elongation of 60% or more and low shrinkage. The circular knit, single-knit jersey fabric is produced by maintaining the draft of the spandex at or below 2× (100% elongation) and maintaining the finishing and drying temperature(s) below the spandex heat set temperature. The knit fabric meets the end-use specifications without heat setting.

27 Claims, 3 Drawing Sheets

METHOD TO MAKE CIRCULAR-KNIT ELASTIC FABRIC COMPRISING SPANDEX AND HARD YARNS

FIELD OF THE INVENTION

This invention relates to circular knitting yarns into fabrics, and specifically to elastic single-knit jersey fabrics comprising both spun and/or continuous filament hard yarns, and bare spandex yarns.

BACKGROUND OF THE INVENTION

Single-knit jersey fabrics are broadly used to make underwear and top-weight garments, such as T-shirts. Compared to woven structures, the knit fabric can more easily deform, or stretch, by compressing or elongating the individual knit stitches (comprised of interconnected loops) that form the knit fabric. This ability to stretch by stitch rearrangement adds to the wearing comfort of garments made from knit fabrics. Even when knit fabrics are constructed of 100% hard yarns, such as cotton, polyester, nylon, acrylics or wool, for example, there is some recovery of the knit stitches to original dimensions after imposed forces are removed. However, this recovery by knit stitch rearrangement generally is not complete because hard yarns, which are not elastomeric, do not provide a recovery force to rearrange the knit stitches. As a consequence, single-knit fabrics may experience permanent deformations or 'bagging' in certain garment areas, such as at the elbows of shirt sleeves, where more stretching occurs.

To improve the recovery performance of circular, single-knit fabrics, it is now common to co-knit a small amount of spandex fiber with the companion hard yarn. As used herein, "spandex" means a manufactured fiber in which the fiber-forming substance is a long-chain synthetic polymer comprised of at least 85% of a segmented polyurethane. The polyurethane is prepared from a polyether glycol, a mixture of diisocyanates, and a chain extender and then melt-spun, dry-spun or wet-spun to form the spandex fiber.

For jersey knit constructions in circular knit machines, the process of co-knitting spandex is called "plating." With plating, the hard yarn and the bare spandex yarn are knitted parallel, side-by-side relation, with the spandex yarn always kept on one side of the hard yarn, and hence on one side of the knitted fabric. FIG. 1 is a schematic illustration of plated knit stitches 10 wherein the knitted yarn comprises spandex 12 and a multi-filament hard yarn 14. When spandex is plated with hard yarn to form a knit fabric, additional processing costs are incurred beyond the added cost of the spandex fiber. For example, fabric stretching and heat setting usually are required in the finishing steps when making elastic knit jersey fabrics.

By "circular knitting" is meant a form of weft knitting in which the knitting needles are organized into a circular knitting bed. Generally, a cylinder rotates and interacts with a cam to move the needles reciprocally for knitting action. The yarns to be knitted are fed from packages to a carrier plate that directs the yarn strands to the needles. The circular knit fabric emerges from the knitting needles in a tubular form through the center of the cylinder.

The steps for making elastic circular-knit fabrics according to one known process 40 are outlined in FIG. 4. Although process variations exist for different fabric knit constructions and fabric end uses, the steps shown in FIG. 4 are representative for making jersey knit elastic fabrics with spun hard yarns, such as cotton. The fabric is first circular knit 42 at conditions of high spandex draft and feed tensions. For example, for single-knit jersey fabrics made with bare spandex plated in every knit course, the prior-art feed tension range is 2 to 4 cN for 22 dtex spandex; 3 to 5 cN for 33 dtex; and 4 to 6 cN for 44 dtex (DuPont Technical Bulletin L410). The fabric is knit in the form of a tube, which is collected under the knitting machine either on a rotating mandrel as a flattened tube, or in a box after it is loosely folded back and forth.

In open-width finishing, the knitted tube is then slit open 44 and laid flat. The open fabric is subsequently relaxed 46, either by subjecting it to steam, or by wetting it by dipping and squeezing (padding). The relaxed fabric is then applied to a tenter frame and heated (for heat setting 46) in an oven. The tenter frame holds the fabric on the edges by pins, and stretches it in both the length and width directions in order to return the fabric to desired dimensions and basis weight. This heat setting is accomplished before subsequent wet processing steps and, consequently, heat setting is often referred to as "pre-setting" in the trade. At the oven exit, the flat fabric is released from the stretcher and then tacked 48 (sewed) back into a tubular shape. The fabric then is processed in tubular form through wet processes 50 of cleaning (scouring) and optional bleaching/dyeing, e.g., by soft-flow jet equipment, and then dewatered 52, e.g., by squeeze rolls or in a centrifuge. The fabric is then "de-tacked" 54 by removing the sewing thread and re-opening the fabric into a flat sheet. The flat, still wet, fabric is then dried 56 in a tenter-frame oven under conditions of fabric overfeed (opposite of stretching) so that the fabric is under no tension in the length (machine) direction while being dried at temperatures below heat-setting temperatures. The fabric is slightly tensioned in the width direction in order to flatten any potential wrinkling. An optional fabric finish, such as a softener, may be applied just prior to the drying operation 56. In some cases a fabric finish is applied after the fabric is first dried by a belt or tenter-frame oven, so that the finish is taken up uniformly by fibers that are equally dry. This extra step involves re-wetting the dried fabric with a finish, and then drying the fabric again in a tenter-frame oven.

Heat setting "sets" spandex in an elongated form. This is also known as redeniering, wherein a spandex of higher denier is drafted, or stretched, to a lower denier, and then heated to a sufficiently high temperature, for a sufficient time, to stabilize the spandex at the lower denier. Heat setting therefore means that the spandex permanently changes at a molecular level so that recovery tension in the stretched spandex is mostly relieved and the spandex becomes stable at a new and lower denier. Heat setting temperatures for spandex are generally in the range of 175 to 200° C. For the prior art process 40 shown in FIG. 4, the heat setting 46 commonly is for about 45 seconds or more at about 190° C.

If heat-setting is not used to "set" the spandex, after the fabric is knitted and released from the constraints of the circular knitting machine, the stretched spandex in the fabric will retract to compress the fabric stitches so that the fabric is reduced in dimensions compared to what those dimensions would be if the spandex were not present. Compression of the stitches in the knitted fabric has three major effects that are directly related to elastic knit fabric properties, and thereby usually renders the fabric inappropriate for subsequent cut and sew operations.

First, stitch compression reduces fabric dimensions and increases fabric basis weight ($g/m^2$) beyond desired ranges for single jersey knit fabrics for use in garments. As a result, the traditional finishing process for elastic circular-knit fabric includes a fabric stretching and heating step, at sufficiently high temperatures and sufficiently long residence time, so that the spandex yarn in the knit will "set" at desired stretched dimensions. After heat setting, the spandex yarn will either not retract, or will retract only modestly below its heat-set dimension. Thus, the heat-set spandex yarn will not significantly compress the knit stitches from the heat-set dimensions. Stretching and heat setting parameters are chosen to yield the desired fabric basis weight and elongation, within relatively tight limits. For a typical cotton-jersey elastic single-knit, the desired elongation is at least 60%, and the basis weight ranges from about 140 to about 240 g/m$^2$.

Second, the more severe the stitch compression, the more the fabric will elongate on a percentage basis, thus far exceeding minimum standards and practical needs. When a plated knit with elastic yarn is compared with a fabric knit without elastic yarn, it is common for the plated elastic knit fabric to be 50% shorter (more compressed) than the fabric without elastic yarn. The plated knit is able to stretch in length 150% or more from this compressed state, and such excessive elongation is generally undesirable in jersey knits for cut and sew applications. This length is in the warp direction of the fabric. Fabrics with high elongation in length (stretch) are more likely to be cut irregularly, and are also more likely to shrink excessively upon washing. Similarly, stitches are compressed by spandex in the width direction, so that fabric width is reduced about 50% as well, far beyond the 15 to 20% as-knit width reduction normally encountered with rigid (non-elastic) fabrics.

Third, the compressed stitches in the finished fabric are at an equilibrium condition between spandex recovery forces and resistance to stitch compression by the companion hard yarn. Washing and drying of the fabric can reduce the hard-yarn resistance, probably in part because of agitation of the fabric. Thus, washing and drying may permit the spandex recovery forces to further compress the knit stitches, which can result in unacceptable levels of fabric shrinkage. Heat-setting the knit fabric serves to relax the spandex and reduce the spandex recovery force. The heat setting operation therefore improves the stability of the fabric, and reduces the amount that the fabric will shrink after repeated washings.

Heat setting is not used for all varieties of weft knit elastic fabrics. In some cases a heavy knit will be desired, such as in double knits/ribs and flat sweater knits. In these cases, some stitch compression by the spandex is acceptable. In other cases, the bare spandex fiber is covered with natural or synthetic fibers in a core-spinning or spindle-covering operation, so that the recovery of the spandex and resultant stitch compression is restrained by the covering. In still other cases, bare or covered spandex is plated only on every second or third knit course, thereby limiting the total recovery forces that compress the knit stitches. In seamless knitting, a process wherein tubular knits are shaped for direct use while being knitted on special machines, the fabric is not heat set because dense, stretchy fabrics are intended. For circular-knit jersey elastic fabrics made for cutting and sewing, however, wherein bare spandex is plated in every course, heat setting is almost always required.

Heat setting has disadvantages. Heat setting is an extra cost to finish knit elastic fabrics that contain spandex, versus fabrics that are not elastic (rigid fabrics). Moreover, high spandex heat-setting temperatures can adversely affect sensitive companion hard yarns, e.g., yellowing of cotton, thereby requiring more aggressive subsequent finishing operations, such as bleaching. Aggressive bleaching can negatively affect fabric tactile properties, such as "hand," and usually requires the manufacturer to include fabric softener to counteract bleaching. Also, heat-sensitive hard yarns, such as those from polyacryonitrile, wool and acetate, cannot be used in high-temperature spandex heat-setting steps, because the high heat-setting temperatures will adversely affect such heat-sensitive yarns.

The disadvantages of heat setting have long been recognized, and, as a result, spandex compositions that heat-set at somewhat lower temperatures have been identified (U.S. Pat. Nos. 5,948,875 and 6,472,494 B2). For example, the spandex defined in U.S. Pat. No. 6,472,494 B2 has a heat set efficiency greater than or equal to 85% at approximately 175–190° C. The heat set efficiency value of 85% is considered a minimum value for effective heat setting. It is measured by laboratory tests comparing the length of stretched spandex before and after heat setting to the before-stretched spandex length. While such lower heat setting spandex compositions provide an improvement, heat setting is still required, and the costs associated with it have not been significantly reduced.

The traditional practice of making and heat setting circular-knit fabrics has further disadvantages. The knit fabric emerges from a circular knitting machine in the form of a continuous tube. As the tube is formed in knitting, it is either rolled under tension onto a mandrel, or it is collected as a flat tube under the knitting machine by plaiting, or loose folding. In either case, the fabric establishes two permanent creases where the fabric tube has been folded or flattened. Although the fabric is "opened" by slitting the fabric tube along one of the creases, subsequent use and cutting of the fabric usually must avoid the remaining crease. This reduces the fabric yield (or the amount of knit fabric that can be further processed into garments).

New methods are sought for making circular-knit, elastic, single-knit jersey fabrics that have bare spandex plated in every knit course, and that avoid the costs and disadvantages associated with heat setting.

SUMMARY OF THE INVENTION

We have surprisingly found that a circular knit, elastic, single jersey fabric that includes bare spandex plated with spun and/or continuous filament hard yarns can be manufactured with commercially acceptable properties without a need for in-fabric spandex heat setting if: (1) the spandex draft is limited during the knitting process; and (2) certain desired single knit jersey fabric parameters are maintained. "Hard yarns" include spun staple yarns, spun staple and continuous filament yarns and continuous filament yarns.

The first aspect of the invention is a method for making a circular knit, single jersey fabric in which bare spandex yarn from 17 to 33 dtex, preferably from 22 to 33 dtex, is plated with a hard yarn of spun and/or continuous filament yarn, or blends thereof, with yarn count (Nm) from 35 to 85, preferably from 44 to 68, most preferably from 47 to 54. Preferably, hard yarn is spun staple yarn of cotton or cotton blended with synthetic fibers or yarn. Other natural and synthetic fibers may be selected for the hard yarn, including nylon, polyester, acrylics and wool, for example.

The spandex and the hard yarn are plated in every knit course. The circular knit, single jersey fabric produced by this knitting method has a cover factor of from 1.3 to 1.9. During the knitting, the draft on the spandex feed is controlled so that the spandex yarn is drafted no more than 2× its original length when knit to form the circular knit, single jersey fabric.

In addition, the knit fabric is finished and dried without heat setting the fabric or the spandex within the fabric. Thus, the fabric is dried at temperatures below the heat setting temperature of the spandex. Finishing may comprise one or more steps, such as cleaning, bleaching, dyeing, drying, and compacting, and any combination of such steps. Preferably, the finishing and drying are carried out at one or more temperatures below 160° C. Drying or compacting is carried out while the knit fabric is in an overfeed condition in the warp direction.

The resulting circular knit, elastic, single jersey knit fabric preferably has a spandex content of from 3.5% to 14% by weight based on the total fabric weight per square meter, more preferably from 5% to 10% by weight based on the total fabric weight per square meter. In addition, such fabric preferably has a cover factor of 1.4.

The second and third aspects of the invention are the circular knit, elastic, single jersey fabrics made according to the inventive method, and garments constructed from such fabrics. The fabric produced by the inventive method preferably is formed with hard yarns of cotton or cotton blends and has a basis weight of 140 to 240 g/m$^2$ most preferably of 170 to 220 g/m$^2$. The fabric preferably also has an elongation of 60% or more, preferably from 60% to 130% in the length (warp) direction, and a shrinkage after washing and drying of about 7% or less, preferably less than 7% in both length and width. Garments may include underwear, t-shirts, and top-weight garments.

While the invention will be described in connection with preferred embodiments below, it is to be understood that the invention is in no way intended to be limited by such description. On the contrary, it is intended to cover all alternatives, modifications and equivalents as may be included within the true spirit and scope of the invention as defined by the claims appended hereto.

DETAILED DESCRIPTION OF THE INVENTION

Figure 2:
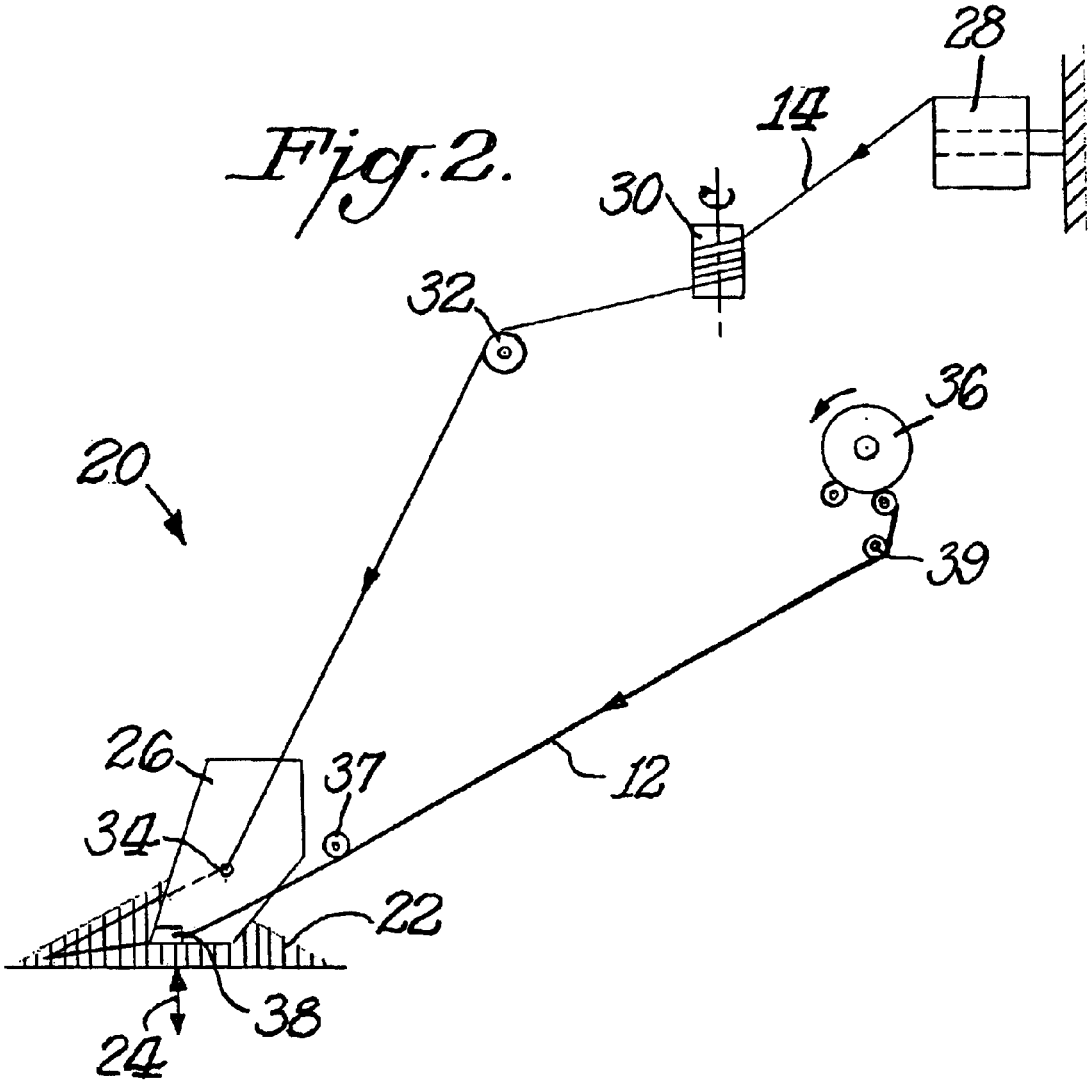
FIG. 2 is a schematic diagram of a portion of a circular knitting machine fed with a spandex feed and a hard yarn feed.

The subject of this patent is circular knitting, and in particular the manufacture of specific knit elastic fabrics for subsequent 'cut and sew' use. Regarding circular knitting, FIG. 2 shows in schematic form one feed position 20 of a circular knitting machine having a series of knitting needles 22 that move reciprocally as indicated by the arrow 24 in response to a cam (not shown) below a rotating cylinder (not shown) that holds the needles. In a circular knitting machine, there are multiple numbers of these feed positions arranged in a circle, so as to feed individual knitting positions as the knitting needles, carried by the moving cylinder, are rotated past the positions.

For plating knit operations, a spandex yarn 12 and a hard yarn 14 are delivered to the knitting needles 22 by a carrier plate 26. The carrier plate 26 simultaneously directs both yarns to the knitting position. The spandex yarn 12 and hard yarn 14 are introduced to the knitting needles 22 at the same or at a similar rate to form a single jersey knit stitch 10 like that shown in FIG. 1.

The hard yarn 14 is delivered from a wound yarn package 28 to an accumulator 30 that meters the yarn to the carrier plate 26 and knitting needles 22. The hard yarn 14 passes over a feed roll 32 and through a guide hole 34 in the carrier plate 26. Optionally, more than one hard yarn may be delivered to the knitting needles via different guide holes in the carrier plate 26.

The spandex 12 is delivered from a surface driven package 36 and past a broken end detector 39 and change of direction roll(s) 37 to a guide slot 38 within the carrier plate 26. The feed tension of the spandex 12 is measured between the detector 39 and drive roll 37, or alternatively between the surface driven package 36 and roll 37 if the broken end detector is not used. The guide hole 34 and guide slot 38 are separated from one another in the carrier plate 26 so as to present the hard yarn 14 and spandex 12 to the knitting needles 22 in side by side, generally parallel relation (plated).

The spandex preferably is a commercially available elastane product for circular knitting, such as Lycra® types T162, T169 and T562.

The spandex stretches (drafts) when it is delivered from the supply package to the carrier plate and in turn to the knit stitch due to the difference between the stitch use rate and the feed rate from the spandex supply package. The ratio of the hard yarn supply rate (meters/min) to the spandex supply rate is normally 2.5 to 4 times (2.5× to 4×) greater, and is known as the machine draft. This corresponds to spandex elongation of 150% to 300%, or more. The feed tension in the spandex yarn is directly related to the draft (elongation) of the spandex yarn. This feed tension is typically maintained at values consistent with high machine drafts for the spandex.

We have found that improved results are obtained when the total spandex draft, as measured in the fabric, is kept to about 2× or less. This draft value is the total draft of the spandex, which includes any drafting or drawing of the spandex that is included in the supply package of as-spun yarn. The value of residual draft from spinning is termed package relaxation, "PR", and it typically ranges from 0.05 to 0.15 for the spandex used in circular knit, elastic, single jersey fabrics. The total draft of the spandex in the fabric is therefore MD*(1+PR), where "MD" is the knitting machine draft. The knitting machine draft is the ratio of hard yarn feed rate to spandex feed rate, both from their respective supply packages.

Because of its stress-strain properties, spandex yarn drafts (draws) more as the tension applied to the spandex increases; conversely, the more that the spandex is drafted, the higher the tension in the yarn. A typical spandex yarn path, in a circular knitting machine, is schematically shown in FIG. 2. The spandex yarn 12 is metered from the supply package 36, over or through a broken end detector 39, over one or more change-of-direction rolls 37, and then to the carrier plate 26, which guides the spandex to the knitting needles 22 and into the stitch. There is a build-up of tension in the spandex yarn as it passes from the supply package and over each device or roller, due to frictional forces imparted by each device or roller that touches the spandex. The total draft of the spandex at the stitch is therefore related to the sum of the tensions throughout the spandex path.

The spandex feed tension is measured between the broken end detector 39 and the roll 37 shown in FIG. 2. Alternatively, the spandex feed tension is measured between the surface driven package 36 and roll 37 if the broken end detector 39 is not used. The higher this tension is set and controlled, the greater the spandex draft will be in the fabric, and vice versa. The prior art teaches that this feed tension should range from 2–4 cN for 22 dtex spandex, and from 4–6 cN for 44 dtex spandex in commercial circular knitting machines. With these feed tension settings and the additional tensions imposed by subsequent yarn-path friction, the spandex in commercial knitting machines will be drafted significantly more than 2×.

This invention does not anticipate all the ways that spandex friction can be minimized between the supply package and the knit stitch. The method requires, however, that friction be minimized to keep the spandex feed tensions sufficiently high for reliable spandex feeding when the spandex draft is 2× or less.

Figure 5:
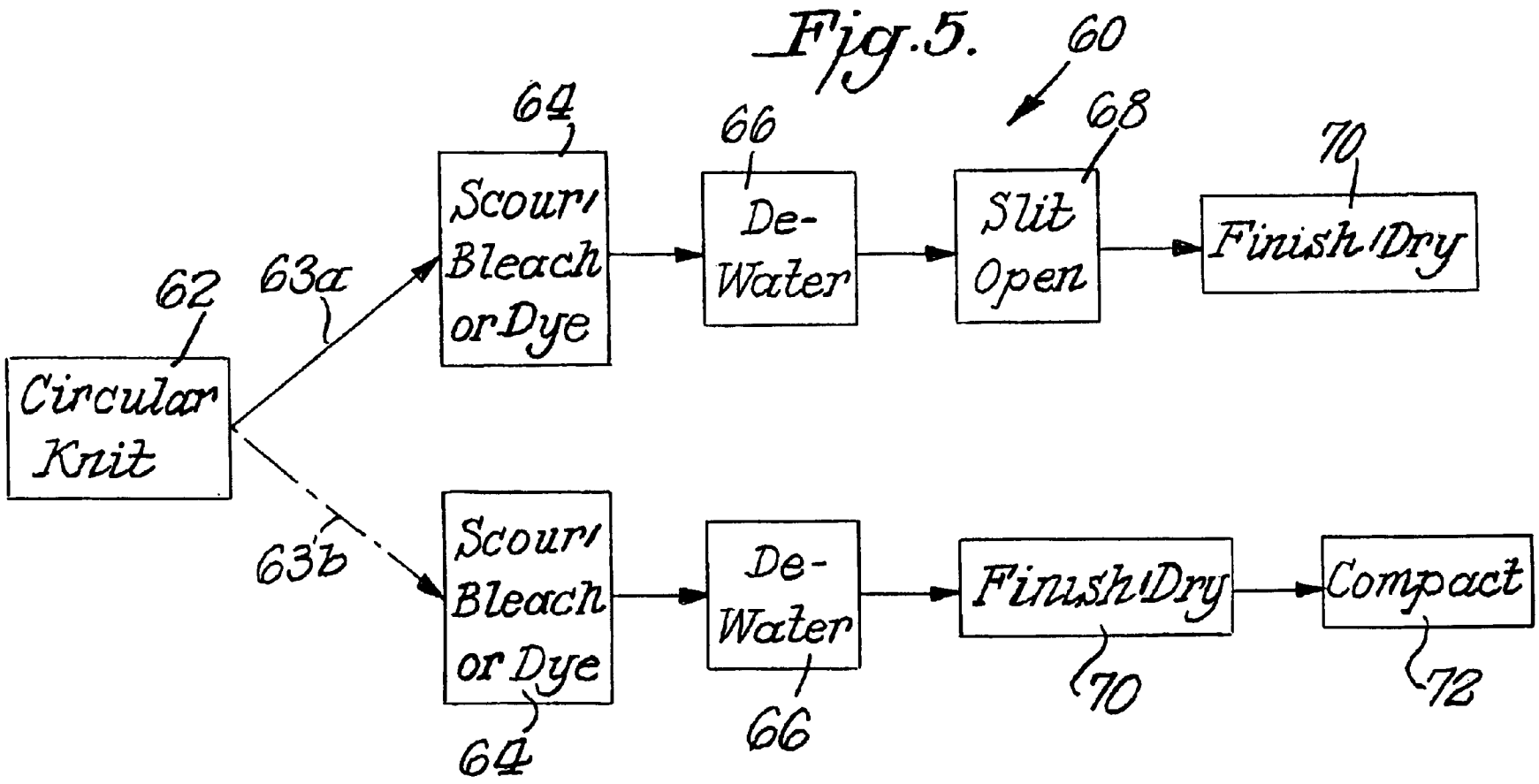
FIG. 5 is a flow chart showing the inventive process steps for making circular-knit, elastic, single-knit jersey fabrics that have bare spandex plated in every knit course.

After knitting a circular knit, elastic, single jersey fabric of plated spandex with hard yarn per the method of this invention, the fabric is finished in either of the alternate processes 60 illustrated diagrammatically in FIG. 5. Drying operations can be carried out on circular knit fabric 62 in the form of an open width web (top row of diagram, path 63*a*), or as a tube (bottom row of diagram, path 63*b*). For either of these paths, wet finishing process steps 64 (such as scouring, bleaching and/or dyeing) are carried out on the fabric while it is in tubular form. One form of dyeing, called soft-flow jet dyeing, usually imparts tension and some length deformation in the fabric. Care should be taken to minimize any additional tension applied during fabric processing and transport from wet finishing to the dryer, and also enable the fabric to relax and recover from such wet-finishing and transport tensions during drying.

Following wet finishing process steps 64, the fabric is dewatered 66, such as by squeezing or centrifuging. In process path 63*a*, the tubular fabric is then slit open 68 before it is delivered to a finish/dry step 70 for optional finish application (e.g., softener by padding) and subsequent drying in a tenter-frame oven under conditions of fabric length overfeed. In process path 63*b*, the tubular fabric is not slit open, but is sent as a tube to the finish/dry step 70. Finish, such as softener, can be optionally applied by padding. The tubular fabric is sent through a drying oven, e.g., laid on a belt, and then to a compactor to separately provide fabric overfeed. A compactor commonly uses rolls to transport the fabric, usually in a steam atmosphere. The first roll(s) is driven at a faster speed of rotation than the second roll(s) so that the fabric has an overfeed. Generally, the steam does not "re-wet" the fabric so that no additional drying is required after compacting.

The drying step 70 (path 63*a*) or the compacting step 72 (path 63*b*), is operated with controlled, high fabric overfeed in the length (machine) direction so that the fabric stitches are free to move and rearrange without tension. A flat, non-wrinkled or non-buckled fabric emerges after drying. These techniques are familiar to those skilled in the art. For open width fabrics, a tenter-frame is used to provide fabric overfeed during drying. For tubular fabrics, forced overfeed is typically provided in a compactor 72, after belt drying. In either open-width or tubular fabric processing, the fabric drying temperature and residence time are set below the values required to heat set the spandex.

Figure 3:
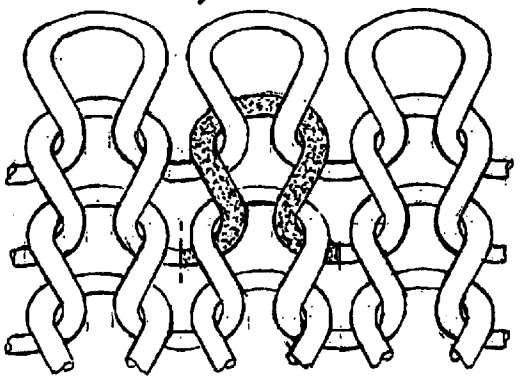
FIG. 3 illustrates a series of single jersey knit stitches and highlights one stitch of stitch length "L"
Figure 3A:
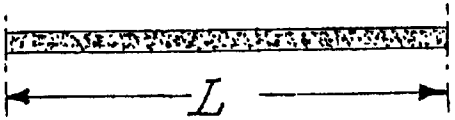
FIG. 3A shows the single stitch of FIG. 3 straightened to illustrate stitch length "L"

The structural design of a circular knit fabric can be characterized in part by the "openness" of each knit stitch. This "openness" is related to the percentage of the area that is open versus that which is covered by the yarn in each stitch (see, e.g., FIGS. 1 and 3), and is thus related to fabric basis weight and elongation potential. For rigid, non-elastic weft knit fabrics, the Cover Factor ("Cf") is well known as a relative measure of openness. The Cover Factor is a ratio and is defined as:

$$Cf=\sqrt{(\text{tex})}\div L$$

where tex is the grams weight of 1000 meters of the hard yarn, and L is the stitch length in millimeters. FIG. 3 is a schematic of a single knit jersey stitch pattern. One of the stitches in the pattern has been highlighted to show how the stitch length, "L" is defined. For yarns of metric count Nm, the tex is 1000÷Nm, and the Cover Factor is alternatively expressed as follows:

$$Cf=\sqrt{(1000/\text{Nm})}\div L.$$

We have found that commercially useful circular knit, elastic, single jersey fabrics plated from bare spandex and a hard yarn can be made without heat setting if the spandex draft is kept about 2× or less, and if the knit fabric is designed and manufactured within the following preferred limits:

- The Cover Factor, which characterizes the openness of the knit structure, is between 1.3 and 1.9, and is preferably 1.4;
- The hard yarn count, Nm, is from 35 to 85, preferably from 44 to 68, and most preferably from 47 to 54;
- The spandex has 17 to 33 dtex, preferably 22 to 33 dtex;
- Preferably, the content of spandex in the fabric, on a % weight basis, is from 3.5% to 14%, and is most preferably from 5% to 10%;
- The knit fabric so formed has a shrinkage after washing and drying of about 7% or less, preferably less than 7% in both the length and width directions;
- The knit fabric has an elongation of 60% or more, preferably from 60% to 130%, in the length (warp) direction; and
- Preferably, the hard yarn is spun staple yarn of cotton or cotton blended with synthetic fibers or yarns.

While not wishing to be bound by any one theory, it is believed that the hard yarn in the knit structure resists the spandex force that acts to compress the knit stitch. The effectiveness of this resistance is related to the knit structure, as defined by the Cover Factor. For a given hard yarn count, Nm, the Cover Factor is inversely proportional to the stitch length, L. This length is adjustable on the knitting machine, and is therefore a key variable for control.

Because the spandex is not heat set in the process of the invention, the spandex draft should be the same in the circular knit, elastic, single jersey as-knit fabric, the finished fabric, or at fabric-processing steps in-between, within the limits of measurement error.

For circular knit, elastic, single jersey fabric, the appropriate gauge of knitting machine is selected according to prior art relationships between hard yarn count and knitting machine gauge. Choice of gauge can be used to optimize circular knit, elastic, single jersey basis weight, for example.

Figure 4:
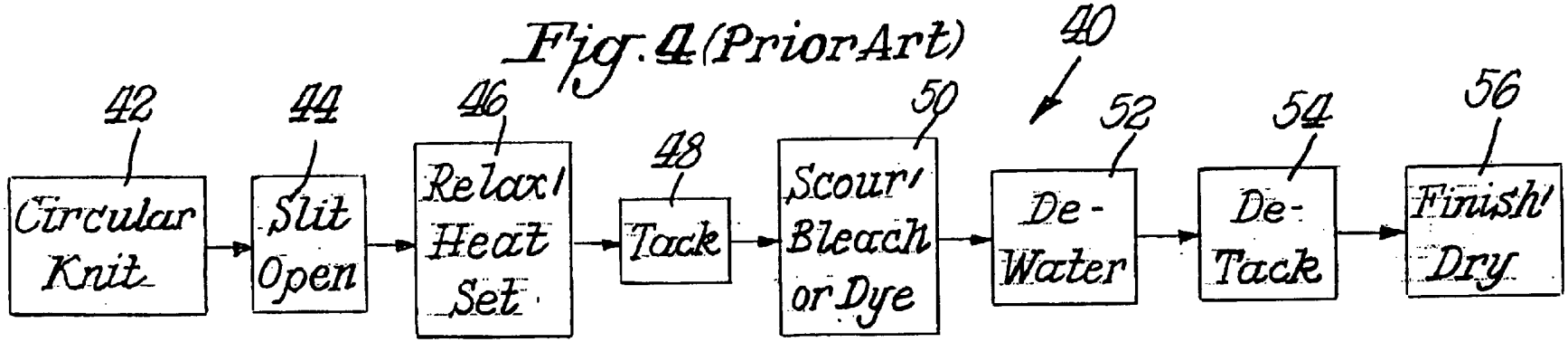
Fig. 4 (Prior Art)
FIG. 4 is a flow chart showing prior art process steps for making circular-knit, elastic, single-knit jersey fabrics that have bare spandex plated in every knit course.

The benefits of this invention are evident when the prior art process shown diagrammatically in FIG. 4, is compared with the inventive process shown diagrammatically in FIG. 5. Traditional knitting and finishing require more process steps, more equipment, and more labor-intensive operations than does either alternative method of the invention shown in FIG. 5. Further, by eliminating high-temperature heat set previously required (see FIG. 4), the inventive process reduces heat damage to fibers like cotton, requires less or no bleaching, and thus improves the 'hand' of the finished fabric. As a further benefit, heat sensitive hard yarns can be used in the invention process to make circular knit, elastic, single jersey fabrics, thus increasing the possibilities for different and improved products.

The use of a softener is optional, but commonly a softener will be applied to the knit fabric to further improve fabric hand, and to increase mobility of the knit stitches during drying. Softeners such as SURESOFT or SANDOPERM SEI are typical. The fabric may be passed through a trough containing a liquid softener composition, and then through the nip between a pair a pressure rollers (padding rollers) to squeeze excess liquid from the fabric.

Also surprisingly, circular knit, elastic, single jersey fabrics knitted by the method of the invention and collected by folding (plaiting), do not crease to the same extent as prior art circular knit single jersey fabrics. Fewer or less visible fold creases in the finished fabric can result in an increased yield for cutting and sewing the fabric into garments. Also unexpectedly, the circular knit, elastic, single jersey fabrics of the invention have significantly reduced skew during process in either open-width or tubular finishing processes, compared to prior art fabrics. With excess skew or spirality, fabrics are diagonally deformed and courses are "on the bias", and are unacceptable. Garments made with skewed fabric will twist on the body.

The following examples demonstrate the invention and its benefits. The invention is capable of other and different embodiments, and its several details are capable of modifications in various apparent respects, without departing from the scope and spirit of the present invention. Accordingly, the examples are to be regarded as illustrative in nature and not as restrictive.

EXAMPLES

Fabric Knitting and Finishing

Circular knit elastic single jersey fabrics with bare spandex plated with hard yarn for the examples were knit on Pai Lung Circular Knitting Machines, either: (1) Model PL-FS3B/T, with 16 inches cylinder diameter, 28 gauge (needles per circumferential inch), and 48 yarn feed positions; or (2) Model PL-XS3B/C, with 26 inches cylinder diameter, 24 gauge, and 78 yarn feed positions. The 28-gauge machine was operated at 24 revolutions per minute (rpm), and the 24-gauge machine at 26 rpm.

The broken end detector in each spandex feed path (see FIG. 2) was either adjusted to reduce sensitivity to yarn tension, or removed from the machines for these examples. The broken end detector was a type that contacted the yarn, and therefore induced tension in the spandex.

The spandex feed tension was measured between the spandex supply package 36 and the roller guide 37 (FIG. 2) with a Zivy digital tension meter, model number, EN-10. For examples of the invention, the spandex feed tensions were maintained at 1 gram or less for 20 and 30-denier spandex. These tensions were sufficiently high for reliable and continuous feeding of the spandex yarn to the knitting needles, and sufficiently low to draft the spandex only about 2× or less. We found that when the feed tensions were too low, the spandex yarn wrapped around the roller guides at the supply package and could not be reliably fed to the circular knitting machine.

All the knitted fabrics were scoured, dyed and dried per the open-width process 63*a* of FIG. 5. With the exception of Example 1A, all knitted fabrics were finished in the same way, and without heat setting. The fabric of Example 1A was also stretched and heat set at 190° C. for a residence time of 60 seconds.

Fabrics were scoured and bleached in a 300-liter solution at 100° C. for 30 minutes. All such wet, jet finishing, including dyeing, was done in a Tong Geng machine (Taiwan) Model TGRU-HAF-30. The water solution contained Stabilizer SIFA (300 g) (silicate free alkaline), NaOH (45%, 1200 g), $H_2O_2$ (35%, 1800 g), IMEROL ST (600 g) for cleaning, ANTIMUSSOL HT2S (150 g) for antifoaming, and IMACOL S (150 g) for anticreasing. After 30 minutes, the solution and fabric were cooled to 75° C. and then the solution was drained. The fabric was subsequently neutralized in a 300 liter solution of water and HAC (150 g) (hydrogen+dona, acetic acid) at 60° C. for 10 minutes.

The fabrics were dyed in a 300-liter solution of water at 60° C. for 60 minutes, using reactive dyestuffs and other constituents. The dye solution contained R-3BF (215 g), Y-3RF (129 g), $Na_2SO_4$ (18,000 g), and $Na_2CO_3$ (3000 g). After 10 minutes, the dyebath was drained and refilled to neutralize with HAC (150 g) for 10 minutes at 60° C. After neutralization, the bath was again drained and refilled with clean water for a 10-minute rinse. Subsequent to neutralization, the 300-liter vessel was again filled with water, and 150 g of SANDOPUR RSK (soap) was added. The solution was heated to 98° C., and the fabrics were washed/soaped for 10 minutes. After draining and another 10 minute clean-water rinse, the fabrics were unloaded from the vessel.

The wet fabrics were then de-watered by centrifuge, for 8 minutes.

For the final step, a lubricant (softener) was padded onto the fabrics in a 77-liter water solution with SANDOPERM SEI liquid (1155 g). The fabrics were then dried in a tenter oven at 145° C. for about 30 seconds, at 50% overfeed.

The above procedure and additives will be familiar to those experienced in the art of textile manufacturing, and circular knitting of single jersey knit fabrics.

Analytical Methods

Spandex Draft—The following procedure, conducted in an environment at 20° C. and 65% relative humidity, is used to measure the spandex drafts in the Examples.

- De-knit (unravel) a yarn sample of 200 stitches (needles) from a single course, and separate the spandex and hard yarns of this sample. A longer sample is de-knit, but the 200 stitches are marked at beginning and end.
- Hang each sample (spandex or hard yarn) freely by attaching one end onto a meter stick with one marking at the top of the stick. Attach a weight to each sample (0.1 g/denier for hard yarn, 0.001 g/denier for spandex). Lower the weight slowly, allowing the weight to be applied to the end of the yarn sample without impact.
- Record the length measured between the marks. Repeat the measurements for 5 samples each of spandex and hard yarn.
- Calculate the average spandex draft according to the following formula:

Draft=(Length of hard yarn between marks)÷(Length of spandex yarn between marks).

Figure 1:
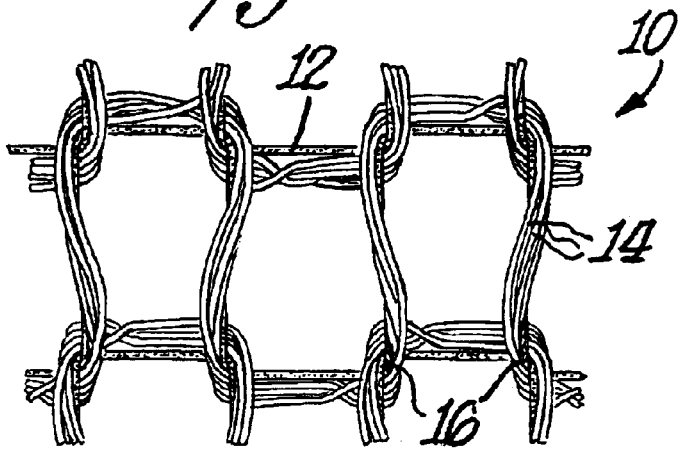
FIG. 1 illustrates plated knit stitches comprising a hard yarn and spandex.

If the fabric has been heat set, as in the prior art, it is usually not possible to measure the in-fabric spandex draft. This is because the high temperatures needed for spandex heat setting will soften the spandex yarn surface and the bare spandex will tack to itself at stitch crossover points 16 in the fabric (FIG. 1). Because of such multiple tack points, one cannot de-knit fabric courses and extract yarn samples.

Fabric Weight—Knit Fabric samples are die-punched with a 10 cm diameter die. Each cut-out knit fabric sample is weighed in grams. The "fabric weight" is then calculated as grams/square meters.

Spandex Fiber Content—Knit fabrics are de-knit manually. The spandex is separated from the companion hard yarn and weighed with a precision laboratory balance or torsion balance. The spandex content is expressed as the percentage of spandex weight to fabric weight.

Fabric Elongation—The elongation is measured in the warp direction only. Three fabric specimens are used to ensure consistency of results. Fabric specimens of known length are mounted onto a static extension tester, and weights representing loads of 4 Newtons per centimeter of length are attached to the specimens. The specimens are exercised by hand for three cycles and then allowed to hang free. The extended lengths of the weighted specimens are then recorded, and the fabric elongation is calculated.

Shrinkage—Two specimens, each of 60×60 centimeters, are taken from the knit fabric. Three size marks are drawn near each edge of the fabric square, and the distances between the marks are noted. The specimens are then sequentially machine washed 3 times in a 12-minute washing machine cycle at 40° C. water temperature and air dried on a table in a laboratory environment. The distances between the size marks are then remeasured to calculate the amount of shrinkage.

Face Curl—A 4-inch×4-inch (10.16 cm×10.16 cm) square specimen is cut from the knit fabric. A dot is placed in the center of the square, and an 'X' is drawn with the dot as the center of the 'X'. The legs of the 'X' are 2 (5.08 cm) inches long and in line with the outside corners of the square. The X is carefully cut with a knife, and then the fabric face curls of two of the internal points created by the cut are measured immediately and again in two minutes, and averaged. If the fabric points curl completely in a 360° circle, the curl is rated as 1.0; if it curls only 180°, the curl is rated ½; and so on. Curl values of ¾ or less are acceptable.

EXAMPLES 1–10

Table 1 below sets forth the knitting conditions for the example knit fabrics. Lycra® types T169 or T562 were used for the spandex feeds. Lycra® deniers were 40, 30, and 20, or 44 dtex, 33 dtex, and 22 dtex, respectively. The stitch length, L, was a machine setting. Table 2 below summarizes key results of the tests for both as-knit fabrics (prior to any finishing), and for finished fabrics. Values of curl were acceptable for all test conditions, and will not be further discussed below. Spandex feed tensions are listed in grams. 1.00 grams equal 0.98 centiNewtons(cN).

TABLE 1

| | Knitting Conditions | | | | | | | |
|---|---|---|---|---|---|---|---|---|
| Example | Lycra ® Type | Lycra ® Denier | Spun Yarn Type | Spun Yarn Count, Nm | Stitch Length, L, mm | Cover Factor, Cf | Lycra ® Feed Tension, grams | Machine Gauge, needles per inch |
| 1 | T169 | 40 | Cotton | 54 | 3.06 | 1.4 | 5 | 28 |
| 1A | T169 | 40 | Cotton | 54 | 3.06 | 1.4 | 5 | 28 |
| 2 | T169 | 20 | Cotton | 54 | 3.06 | 1.4 | 1 | 28 |
| 3 | T169 | 20 | Cotton | 54 | 3.06 | 1.4 | 0.8 | 28 |
| 4 | T169 | 20 | Cotton | 54 | 2.3 | 1.87 | 1 | 28 |
| 5 | T169 | 20 | Cotton | 54 | 3.57 | 1.2 | 1 | 28 |
| 6 | T169 | 20 | Cotton | 68 | 3.06 | 1.25 | 1 | 28 |
| 7 | T169 | 20 | Cotton | 54 | 3.06 | 1.4 | 1 | 24 |
| 8 | T169 | 30 | Cotton | 68 | 2.75 | 1.4 | 1 | 28 |
| 9 | T169 | 20 | Cotton-Polyester | 55 | 3.06 | 1.4 | 1 | 28 |
| 10 | T562 | 20 | Cotton | 54 | 3.06 | 1.4 | 1 | 28 |

TABLE 2

| | RESULTS | | | | | | | |
|---|---|---|---|---|---|---|---|---|
| | As-Knit | | Finished | | | | | |
| Example | Basis Weight, g/m2 | Maximum Length Elongation % | Lycra* Draft | Basis Weight, g/m2 | Maximum Length Elongation % | Lycra* Content in Fabric, % Weight | Shrinkage %, Warp by Weft | Face Curl, Fraction of 360° |
| 1 | 266 | 169 | 2.7 | 306 | 169 | 7.6 | 7.4 × 5.7 | 1/4 |
| 1A | 266 | 169 | NA | 204 | 115 | 7.6 | 5.1 × 0.8 | 1/4 |
| 2 | 191 | 106 | 2 | 218 | 105 | 5.9 | 3.3 × 4.2 | 1/4 |
| 3 | 194 | 92 | 1.8 | 206 | 88 | 6.4 | 2.6 × 4.2 | 1/4 |
| 4 | 200 | 84 | 1.9 | 229 | 65 | 6 | 2.9 × 3.8 | 1/4 |
| 5 | 204 | 139 | 2.2 | 204 | 114 | 4.8 | 16.1 × 0.7 | 1/4 |
| 6 | 164 | 123 | 2 | 178 | 98 | 7.1 | 12.4 × 2.7 | 1/4 |

TABLE 2-continued

| | RESULTS | | | | | | | |
|---|---|---|---|---|---|---|---|---|
| | As-Knit | | Finished | | | | | |
| Example | Basis Weight, g/m2 | Maximum Length Elongation % | Lycra* Draft | Basis Weight, g/m2 | Maximum Length Elongation % | Lycra* Content in Fabric, % Weight | Shrinkage %, Warp by Weft | Face Curl, Fraction of 360° |
| 7 | 191 | 147 | 1.9 | 208 | 104 | 6 | 4.0 × 4.3 | 1/4 |
| 8 | 168 | 99 | 1.7 | 178 | 89 | 12.1 | 5.6 × 4.4 | 3/4 |
| 9 | 173 | 80 | 2 | 229 | 112 | 5.9 | 2.4 × 1.3 | 1/4 |
| 10 | 190 | 104 | 1.9 | 207 | 96 | 6.4 | 3.3 × 3.7 | 1/4 |

EXAMPLE 1

High Draft without Heat Setting (Prior Art)

The 40-denier spandex feed tension was 5 grams (4.9 cN), which is in the range of 4 to 6 cN recommended in the prior art. Because of the compressive forces of the spandex, the as-knit fabric basis weight was high (266 g/m$^2$), and higher still in the finished fabric (306 g/m$^2$). Shrinkage also exceeded 7% in the length direction. These values exceed commercial objectives, and the knit fabric would need to be heat set before it could be made into a garment.

EXAMPLE 1A

High Draft with Heat Setting (Prior Art)

The knit fabric of Example 1 was stretched and heat set at 190° C. for 60 seconds. The as-knit weight and elongation properties were the same as or Example 1, but heat setting reduced the finished fabric to 204 g/m$^2$ and 115% elongation, which are both desirable for circular knit elastic single jersey fabric. Shrinkage was acceptable. Spandex draft and content could not be measured by the analytical methods above, as the heat-set fabric could not be de-knitted because the bare spandex tacked together. The spandex content, however, was the same as for Example 1. Examples 1 and 1A demonstrate that heat setting is required for prior methods of making circular knit elastic single jersey fabrics that incorporate plated bare spandex.

EXAMPLE 2

Invention: Best Mode

Parameters were set at the most preferred values. Cotton count was 54 Nm, the cover factor was 1.4, the spandex denier was 20, and the spandex draft was 2.0. The spandex was Lycra* Type 169. The knit fabric was not heat set. Knit fabric finished values of basis weight, elongation and shrinkage were acceptable.

EXAMPLE 3

Invention: Reduced Tension and Draft

The 20-denier spandex feed tension was lowered to 0.8 grams (0.78 cN). For the Pai Lung knitting machine and spandex yarn path, this was a minimum value for feed tension to maintain continuity of spandex takeoff from the supply package. The knit fabric was not heat set. Finished values of basis weight, elongation, and shrinkage were acceptable.

EXAMPLE 4

Invention: High Cover Factor

The stitch length was reduced to 2.3 mm so that the cover factor was 1.87, near the upper limit of the invention. The knit fabric was not heat set. The finished fabric weight was relatively high (229 g/m$^2$) and the elongation was 65%, practically at the lower limit of 60%, as defined by commercial usefulness. Shrinkage was quite low.

EXAMPLE 5

Comparison: Below-limit Cover Factor

The stitch length was increased to 3.57 mm in order to reduce the cover factor to a value of 1.2. This value is below the limits of the invention (lower limit—1.3). The knit fabric was not heat set. Finished fabric weight and elongation were acceptable, but the shrinkage was not (length 16.1%). The spandex draft was also slightly above 2.2 because, probably because of interactions of spandex drafting by knitting needle friction at longer stitch lengths.

EXAMPLE 6

Comparison: Higher Spun Yarn Count and Below-limit Cover Factor

Cotton spun yarn count was increased from 54 to 68 Nm for this example. Stitch length was maintained at 3.06 mm, so that the cover factor was reduced to 1.25 by this change in spun yarn count. The knit fabric was not heat set. Again, the fabric weight and elongation were acceptable, but the shrinkage was not (12.4% in length).

EXAMPLE 7

Invention: Different Machine Gauge

Knitting machine model PL-XS3B/C, with a gauge of 24 needles per circumferential inch, was used to knit the fabric of this example. All knitting and fabric design variables were within the invention. The knit fabric was not heat set. Fabric weight (208 g/m$^2$), elongation (104%) and shrinkage (4.3% max) were all acceptable, and directly comparable to results of Example 1A, wherein the knit fabric had been heat set.

EXAMPLE 8

Invention: High Spandex Content

The spandex denier was increased to 30 denier, and the cotton count was increased to 68 Nm (denier reduced), so that the % spandex content in the fabric increased to 12.1%. This content was higher than the other examples, but still within the limits of the invention. Stitch length was reduced to maintain the cover factor at 1.4. The knit fabric was not heat set. Fabric weight, elongation and shrinkage were all acceptable.

EXAMPLE 9

Invention: Different Type Spun Yarn

Two hard yarns were plated, together with the spandex, into the knit stitches. The first hard yarn was spun cotton with count 60 Ne, or 101.6 Nm. The second hard yarn was continuous filament polyester yarn of 83 dtex and 34 filaments. These were plated together with 22 dtex (20 denier) spandex. The combined hard yarn count was 55 Nm. The knit fabric was not heat set. Fabric weight, elongation and shrinkage were all acceptable.

EXAMPLE 10

Invention: Best Mode-different Type Spandex Yarn

Process parameters were the same as in Example 2, except that a different spandex yarn, Lycra* Type 562 ('easy-set') was used for the spandex feed. The knit fabric was not heat set. Results were acceptable, and comparable to example 2.

We claim:

1. In a method for making a circular knit, single jersey fabric in which bare spandex yarn from 17 to 33 dtex is plated with one or more spun or continuous filament hard yarns, or blends thereof, with yarn count from 35 to 85, and in which the spandex and hard yarn(s) are plated in every knit course to produce the circular knit, single jersey fabric with a cover factor of from 1.3 to 1.9, wherein the improvement comprises:

controlling the draft on the spandex feed so that the spandex yarn is drafted no more than 2× its original length when knit to form the circular knit, single jersey fabric; and finishing and drying the knit fabric while maintaining the fabric at a temperature below such temperature required to heat set the spandex.

2. The method of claim 1, wherein the knit fabric is maintained at temperatures below 160° C. during finishing and drying.

3. The method of claim 1, wherein the knit fabric has a length in the warp direction and is dried or compacted while subject to an overfeed in its length.

4. The method of claim 1, wherein the knit fabric has a spandex content of from 3.5% to 14% by weight based on the total fabric weight per square meter.

5. The method of claim 4, wherein the knit fabric has a spandex content of from 5% to 10% by weight based on the total fabric weight per square meter.

6. The method of claim 1, wherein the cover factor of the knit fabric is 1.4.

7. The method of claim 1, wherein finishing comprises one or more steps selected from the group consisting of: cleaning, bleaching, dyeing, drying, and compacting and any combination of such steps.

8. The method of claim 1, wherein the hard yarn is selected from the group consisting of spun cotton and cotton blended with synthetic fiber or yarn.

9. A method for making a circular knit, elastic, single knit jersey fabric, consisting essentially of:

plating a bare spandex yarn with a hard yarn, wherein the spandex is from 17 to 33 dtex and can be heat set within a heat setting efficiency of at least 85% at a heat setting temperature, and wherein the hard yarn has a total yarn count (Nm) of 35 to 85;

circular knitting the plated bare spandex yarn and hard yarn in every knit course to form a single knit jersey fabric having a cover factor of from 1.3 to 1.9;

controlling the feed of the spandex so that the spandex in the fabric is drafted no more than 2× its original length; and maintaining the fabric below the heat setting temperature of the spandex during further processing.

10. The method of claim 9, wherein the spandex is present in the fabric in an amount from 3.5% to 14% by weight based on the total fabric weight per square meter.

11. The method of claim 10, wherein the spandex is present in the fabric in an amount from 5% to 10% by weight based on the total fabric weight per square meter.

12. The method of claim 9, wherein the fabric has a cover factor of 1.4.

13. The method of claim 9, further comprising drying or compacting the fabric in an overfeed condition.

14. The method of claim 9, wherein the fabric is maintained at temperatures below 160° C. during further processing.

15. The method of claim 9, wherein further processing comprises one or more steps selected from the group consisting of: cleaning, bleaching, dyeing, drying, and compacting, and any combination of such steps.

16. A circular knit, elastic, single knit jersey fabric made by the method of claim 1.

17. The circular knit, elastic, single knit jersey fabric of claim 16, wherein the hard yarn is cotton or a cotton blend, and the fabric has a basis weight of from 140 to 240 g/m$^2$.

18. The circular knit, elastic, single knit jersey fabric of claim 16, wherein the fabric has an elongation of at least 60% in its length (warp) direction.

19. The circular knit, elastic, single knit jersey fabric of claim 16, wherein the fabric has a shrinkage of 7% or less after washing.

20. A circular knit, elastic, single knit jersey fabric made by the method of claim 9.

21. The circular knit, elastic, single knit jersey fabric of claim 20, wherein the hard yarn is cotton or a cotton blend, and the fabric has a basis weight of from 140 to 240 g/m$^2$.

22. The circular knit, elastic, single knit jersey fabric of claim 20, wherein the fabric has an elongation of at least 60% in its length (warp) direction.

23. The circular knit, elastic, single knit jersey fabric of claim 20, wherein the fabric has a shrinkage of 7% or less after washing.

24. A garment made from the circular knit, elastic, single knit jersey fabric of claim 16.

25. A garment made from the circular knit, elastic, single knit jersey fabric of claim 17.

26. A garment made from the circular knit, elastic, single knit jersey fabric of claim 20.

27. A garment made from the circular knit, elastic, single knit jersey fabric of claim 21.

* * * * *

UNITED STATES PATENT AND TRADEMARK OFFICE

CERTIFICATE OF CORRECTION

PATENT NO. : 6,776,014 B1
DATED : August 17, 2004
INVENTOR(S) : Graham H. Laycock et al.

It is certified that error appears in the above-identified patent and that said Letters Patent is hereby corrected as shown below:

Title page,
Item [56], References Cited, OTHER PUBLICATIONS, second reference,
"DuPont: "Wet Processing of Fabrics Containing LYCRA Elastane" Tchnical Bulletin L704, Oct. 15, 1999, pp. 1-21" should read:
-- DuPont: "Wet Processing of Fabrics Containing LYCRA Elastane" Technical Bulletin L704, Oct. 15, 1999, pp. 1-21 --.

Signed and Sealed this

Thirtieth Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,776,014 B1
DATED : August 17, 2004
INVENTOR(S) : Graham H. Laycock et al.

It is certified that error appears in the above-identified patent and that said Letters Patent is hereby corrected as shown below:

Title page,
Item [22], Filing Date, should read -- June 2, 2003 --.

Signed and Sealed this

Fourth Day of January, 2005

JON W. DUDAS
*Director of the United States Patent and Trademark Office*